US009284493B2

(12) United States Patent
Laricchia et al.

(10) Patent No.: US 9,284,493 B2
(45) **Date of Patent: *Mar. 15, 2016**

(54) PROCESS FOR TREATING A LIQUID HYDROCARBON STREAM

(71) Applicant: UOP, LLC, Des Plaines, IL (US)

(72) Inventors: Luigi Laricchia, Arlington Heights, IL (US); Jessy E. Trucko, Lake Forest, IL (US)

(73) Assignee: UOP LLC, Des Plaines, IL (US)

( * ) Notice: Subject to any disclaimer, the term of this patent is extended or adjusted under 35 U.S.C. 154(b) by 221 days.

This patent is subject to a terminal disclaimer.

(21) Appl. No.: 13/920,407

(22) Filed: Jun. 18, 2013

(65) Prior Publication Data

US 2014/0371509 A1 Dec. 18, 2014

(51) Int. Cl.

| | |
|---|---|
| ***C10G 19/02*** | (2006.01) |
| ***C10G 21/27*** | (2006.01) |
| ***C10G 53/14*** | (2006.01) |

(52) U.S. Cl.

CPC ..... *C10G 19/02* (2013.01); *C10G 21/27* (2013.01); *C10G 53/14* (2013.01); *C10G 2300/202* (2013.01)

(58) Field of Classification Search

None

See application file for complete search history.

(56) References Cited

U.S. PATENT DOCUMENTS

| | | | |
|---|---|---|---|
| 2,230,654 | A | 2/1941 | Plunkett |
| 2,594,311 | A | 4/1952 | Johnson et al. |
| 2,726,992 | A | 12/1955 | Easthagen et al. |
| 3,497,569 | A | 2/1970 | Stiles |
| 4,199,440 | A | 4/1980 | Verachtert |
| 4,208,541 | A | 6/1980 | McClure |
| 4,336,233 | A | 6/1982 | Appl et al. |
| 4,461,749 | A | 7/1984 | Thorn |
| 4,490,246 | A | 12/1984 | Verachtert |
| 4,562,300 | A | 12/1985 | LaFoy |
| 4,626,341 | A | 12/1986 | Verachtert |
| 4,666,689 | A | 5/1987 | Maple et al. |
| 4,735,704 | A | 4/1988 | Kister et al. |
| 4,808,765 | A | 2/1989 | Pearce et al. |
| 4,957,715 | A | 9/1990 | Grover et al. |
| 5,149,340 | A | 9/1992 | Waycuilis |
| 5,246,619 | A | 9/1993 | Niswander |
| 5,456,661 | A | 10/1995 | Narciso, Jr. |
| 5,523,069 | A | 6/1996 | Lin |

(Continued)

FOREIGN PATENT DOCUMENTS

| | | |
|---|---|---|
| EP | 0227259 A1 | 7/1987 |
| GB | 815193 | 6/1959 |

(Continued)

OTHER PUBLICATIONS

Search Report dated Oct. 22, 2014 for corresponding PCT Appl. No. PCT/US2014/041842.

(Continued)

*Primary Examiner* — Tam M Nguyen

(74) *Attorney, Agent, or Firm* — James C. Paschall

(57) ABSTRACT

One exemplary embodiment can be a process for treating a liquid hydrocarbon stream. The process can include passing the liquid hydrocarbon stream previously contacted with a solvent having an alkanolamine consisting of diethanolamine, a methyl diethanolamine, or a mixture thereof, and an alkali to a vessel. Generally, the vessel contains a coalescing zone for removing at least one of hydrogen sulfide and carbonyl sulfide.

20 Claims, 2 Drawing Sheets

(56) References Cited

U.S. PATENT DOCUMENTS

| | | | |
|---|---|---|---|
| 5,601,702 | A | 2/1997 | Yan |
| 5,877,386 | A | 3/1999 | Schubert |
| 5,997,731 | A | 12/1999 | Suarez |
| 6,334,949 | B1 | 1/2002 | Bruno et al. |
| 6,852,144 | B1 | 2/2005 | Wagner et al. |
| 7,119,244 | B2 | 10/2006 | Smith, Jr. |
| 7,223,332 | B1 | 5/2007 | Tertel |
| 7,326,333 | B2 | 2/2008 | Laricchia et al. |
| 7,381,309 | B1 | 6/2008 | Laricchia et al. |
| 7,604,724 | B2 | 10/2009 | Mortson |
| 7,875,185 | B2 | 1/2011 | Zhang |
| 7,985,331 | B2 | 7/2011 | Baudot et al. |
| 8,028,975 | B2 | 10/2011 | Tertel et al. |
| 8,080,087 | B2 | 12/2011 | Falkiner et al. |
| 8,088,281 | B2 | 1/2012 | Falkiner et al. |
| 8,173,856 | B2 | 5/2012 | Tertel |
| 8,308,957 | B2 | 11/2012 | Zhang et al. |
| 8,313,718 | B2 | 11/2012 | Bedell |
| 2002/0144942 | A1 | 10/2002 | Denton et al. |
| 2009/0134068 | A1 | 5/2009 | Falkiner et al. |
| 2009/0151237 | A1 | 6/2009 | Takegoshi et al. |
| 2011/0142738 | A1 | 6/2011 | Pandya et al. |
| 2012/0000827 | A1 | 1/2012 | Krupa et al. |

FOREIGN PATENT DOCUMENTS

| | | | |
|---|---|---|---|
| WO | 2005069965 | A2 | 8/2005 |
| WO | 2005121279 | | 12/2005 |

OTHER PUBLICATIONS

"New Developments . . . Coalescers Eliminate Gasoline Haze", Hydrocarbon Processing, Feb. 2001, vol. 80, No. 2, pp. 118, 124.

Doran et al., "Removal of Trace H2S and COS from Liquid Streams", Petroleum Technology Quarterly, Autumn 1996, pp. 41-44.

Pai et al., "Gas Processing Options for Mercaptans and Carbonyl Sulfide Removal from NG and NGL Streams", AIChE 1993 Spring National Meeting Presentation paper, Mar. 28, 1993, No. Preprint N.75g, pp. 25 pages.

McClure et al., "Amine Process Removes COS from Propane Economically", The Oil and Gas Journal, Jul. 2, 1979, vol. 77, No. 27, pp. 106-108.

Nielsen et al., "Treat LPGs with Amines", Hydrocarbon Processing, Sep. 1997, vol. 76, No. 9, pp. 49-50, 53-54, 56, 58-59.

"Coalescer Removes Dispersed, Nondissolved Liquid Contaminants", Chemical Engineering Progress, Apr. 2001, vol. 97, No. 4, pp. 27.

Weber et al., "The Cosden/Malaprop Process for Light Hydrocarbon Desulfurization", National Petroleum Refiners Association 1981 NPRA Annual Meeting Presentation, Mar. 29-31, 1981, No. PAP.N. AM-81-49, pp. 14 pages.

Wines et al., "Difficult Liquid—High-Performance, Polymer-Fiber Coalescers Break Up Hard-to-Handle Emulsions and Dispersions", Chemical Engineering, vol. 104, No. 12, Dec. 1997, pp. 104-109.

U.S. Appl. No. 13/920,432, filed Jun. 18, 2013, Laricchia.

U.S. Appl. No. 13/920,477, filed Jun. 18, 2013, Laricchia.

U.S. Appl. No. 13/920,507, filed Jun. 18, 2013, Laricchia.

U.S. Appl. No. 13/920,532, filed Jun. 18, 2013, Laricchia.

PROCESS FOR TREATING A LIQUID HYDROCARBON STREAM

FIELD OF THE INVENTION

This invention generally relates to a process for treating a liquid hydrocarbon stream.

DESCRIPTION OF THE RELATED ART

Often, hydrocarbon streams are treated to remove sulfur-containing compounds, such as mercaptans. Generally, mercaptans are removed because of their malodorous scent. Additionally, it is usually desirable to remove other compounds, such as carbonyl sulfide. As such, additional equipment may be utilized to remove these other compounds. Such equipment may be provided solvents for removing these compounds. The provided solvents may be limited to particular types and can carryover to downstream units causing upsets. It would be preferable to overcome such shortcomings by reducing the number of equipment pieces, minimize upsets of downstream units, and provide more flexibility with respect to solvents. Thus, improving operability and efficiency of such processes is desirable.

SUMMARY OF THE INVENTION

One exemplary embodiment can be a process for treating a liquid hydrocarbon stream. The process can include passing the liquid hydrocarbon stream previously contacted with a solvent having an alkanolamine consisting of diethanolamine, a methyl diethanolamine, or a mixture thereof, and an alkali to a vessel. Generally, the vessel contains a coalescing zone for removing at least one of hydrogen sulfide and carbonyl sulfide.

Another exemplary embodiment may be a process for treating a liquid hydrocarbon stream. The process can include passing the liquid hydrocarbon stream previously contacted with a solvent including a diethanolamine, an alkali, and water to a contacting zone, and passing the contacted stream to a coalescing zone having a hydrophilic mesh for removing at least one of hydrogen sulfide and carbonyl sulfide.

A further exemplary embodiment can be a process for treating a liquid hydrocarbon stream. The process can include passing the liquid hydrocarbon stream previously contacted with a solvent including an alkanolamine consisting of a diethanolamine, a methyl diethanolamine, or a mixture thereof, and an alkali through a contacting zone, passing the contacted stream to a vessel containing a coalescing zone for removing at least one of hydrogen sulfide and carbonyl sulfide, and passing a stream from the vessel to an extraction zone.

The embodiments disclosed herein can remove carbonyl sulfide upstream instead of downstream of an extraction zone. Hence, the embodiments herein can reduce the overall cost of the process by eliminating downstream equipment, such as a carbonyl sulfide settler, a sand filter, and/or a water wash of hydrocarbon product streams. Moreover, carryover to downstream units can be minimized preventing upsets in those units. Additionally, solvent flexibility can be increased, such as allowing the use of diethanolamine, sodium hydroxide, and water solutions. Furthermore, existing units may be revamped to use the diethanolamine, sodium hydroxide, and water solution solvents instead of a caustic-water solution.

DEFINITIONS

As used herein, the term "stream" can include various hydrocarbon molecules, such as straight-chain, branched, or cyclic alkanes, alkenes, alkadienes, and alkynes, and optionally other substances, such as gases, e.g., hydrogen, or impurities, such as heavy metals, and sulfur and nitrogen compounds. The stream can also include aromatic and non-aromatic hydrocarbons. Moreover, the hydrocarbon molecules may be abbreviated C1, C2, C3 . . . Cn where "n" represents the number of carbon atoms in the one or more hydrocarbon molecules. Furthermore, a superscript "+" or "−" may be used with an abbreviated one or more hydrocarbons notation, e.g., $C3^{+}$ or $C3^{-}$, which is inclusive of the abbreviated one or more hydrocarbons. As an example, the abbreviation "$C3^{+}$" means one or more hydrocarbon molecules of three carbon atoms and/or more. In addition, the term "stream" may be applicable to other fluids, such as aqueous and non-aqueous solutions of alkaline or basic compounds, such as sodium hydroxide.

As used herein, the term "zone" can refer to an area including one or more equipment items and/or one or more sub-zones. Equipment items can include one or more reactors or reactor vessels, heaters, exchangers, pipes, pumps, compressors, and controllers. Additionally, an equipment item, such as a reactor, dryer, or vessel, can further include one or more zones or sub-zones.

As used herein, the term "rich" can mean an amount of at least generally about 50%, and preferably about 70%, by mole, of a compound or class of compounds in a stream. If referring to a solute in solution, e.g., one or more disulfide compounds in an alkaline solution, the term "rich" may be referenced to the equilibrium concentration of the solute. As an example, about 5%, by mole, of a solute in a solvent may be considered rich if the concentration of solute at equilibrium is about 10%, by mole.

As used herein, the term "substantially" can mean an amount of at least generally about 80%, preferably about 90%, and optimally about 99%, by mole, of a compound or class of compounds in a stream.

As used herein, the term "coupled" can mean two items, directly or indirectly, joined, fastened, associated, connected, or formed integrally together either by chemical or mechanical means, by processes including stamping, molding, or welding. What is more, two items can be coupled by the use of a third component such as a mechanical fastener, e.g., a screw, a nail, a bolt, a staple, or a rivet; an adhesive; or a solder.

As used herein, the term "coalescer" may be a media containing an optionally coated metal mesh, glass fibers, or other material to facilitate separation of immiscible liquids of similar density.

As used herein, the term "immiscible" can mean two or more phases that cannot be uniformly mixed or blended.

As used herein, the term "phase" may mean a liquid, a gas, or a suspension including a liquid and/or a gas, such as a foam, aerosol, or fog. A phase may include solid particles. Generally, a fluid can include one or more gas, liquid, and/or suspension phases.

As used herein, the term "alkali" can mean any substance that in solution, typically a water solution, has a pH value greater than about 7.0, and exemplary alkali can include sodium hydroxide, potassium hydroxide, or ammonia. Such an alkali in solution may be referred to as "an alkaline solution" or "an alkaline" and includes caustic, i.e., sodium hydroxide in water.

As used herein, the term "parts per million" may be abbreviated herein as "ppm" and "weight ppm" may be abbreviated herein as "wppm".

As used herein, the term "mercaptan" typically means thiol and may be used interchangeably therewith, and can include compounds of the formula RSH as well as salts thereof, such as mercaptides of the formula $RS^-M^+$ where R is a hydrocarbon group, such as an alkyl or aryl group, that is saturated or unsaturated and optionally substituted, and M is a metal, such as sodium or potassium.

As used herein, the weight percent or ppm of sulfur, e.g., "wppm-sulfur" is the amount of sulfur, and not the amount of the sulfur-containing species unless otherwise indicated. As an example, methylmercaptan, $CH_3SH$, has a molecular weight of 48.1 with 32.06 represented by the sulfur atom, so the molecule is about 66.6%, by weight, sulfur. As a result, the actual sulfur compound concentration can be higher than the wppm-sulfur from the compound.

As used herein, the term "lean" can describe a fluid optionally having been treated and desired levels of sulfur, including one or more mercaptans and one or more disulfides for treating one or more C1-C15 hydrocarbons.

As used herein, the term "liquefied petroleum gas" can refer to one or more C1-C4 hydrocarbons, typically one or more C3-C4 hydrocarbons, having a boiling point of about −160-about 0° C. at atmospheric pressure.

As used herein, the term "naphtha" can refer to one or more C5-C12 hydrocarbons having a boiling point of about 25-about 190° C. at atmospheric pressure.

As used herein, the term "kerosene" can refer to one or more C9-C15 hydrocarbons having a boiling point of about 160-about 275° C. at atmospheric pressure.

As used herein, the terms "degrees Celsius" may be abbreviated "° C." and the term "kilopascal" may be abbreviated "KPa" and all pressures disclosed herein are absolute.

As depicted, process flow lines in the figures can be referred to, interchangeably, as, e.g., lines, pipes, branches, distributors, streams, effluents, feeds, products, portions, catalysts, withdrawals, recycles, suctions, discharges, and caustics.

DETAILED DESCRIPTION

Figure 1:
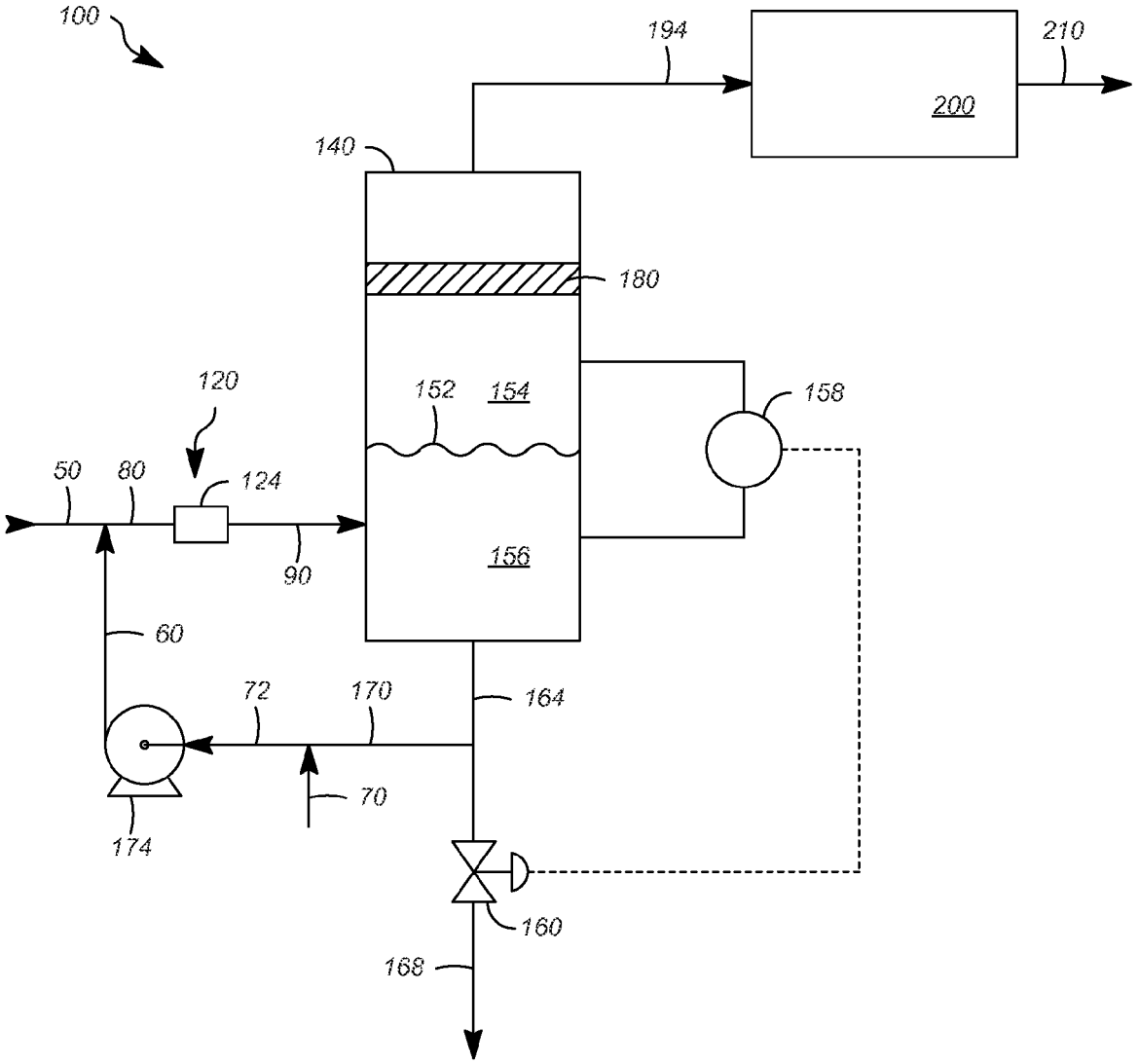
FIG. 1 is a schematic depiction of an exemplary apparatus for removing carbonyl sulfide.

Referring to FIG. 1, an apparatus 100 can include a contacting zone 120, a vessel 140, such as a prewash vessel 140, and an extraction zone 200. A liquid hydrocarbon stream 50, such as a liquefied petroleum gas, a naphtha, or a kerosene, containing one or more sulfur compounds, such as one or more thiol compounds or hydrogen sulfide, may be provided to the apparatus 100. Usually, the liquid hydrocarbon stream 50 can be rich or substantially include one or more C1-C15 hydrocarbons, and can be substantially in a liquid phase. The liquid hydrocarbon stream 50 may also contain about 50-about 500 ppm, by weight, carbonyl sulfide and be combined with a solvent or recycle stream 60, as hereinafter described, to form a combined stream 80 before entering the contacting zone 120.

The contacting zone 120 can include any suitable device, such as a jet educator mixer, a structured column packing, a random packing, a sieve tray, and/or a static mixer. In this exemplary embodiment, a static mixer 124 can thoroughly blend the components of the streams 50 and 60. A contacted stream 90 from the contacting zone 120 may be passed to the vessel or prewash vessel 140.

In this exemplary embodiment, the prewash vessel 140 can be orientated substantially vertical. The prewash vessel 140 can include a coalescing zone 180, which can include at least one of a mesh and one or more vanes to form a circular disk across an entire cross-section of the prewash vessel 140. Generally, the coalescing zone 180 may include a hydrophilic media having at least one of a metal mesh that is optionally coated; one or more glass fibers, such as fiberglass; corrugated sheet media; or a metal, such as stainless steel, mesh or wires. One exemplary hydrophilic coated mesh may include a coating sold under the trade designation COALEX or KOCH-OTTO YORK™ separations technology by Koch-Glitsch, LP of Wichita, Kans.

Downstream of the prewash vessel 140 may be an extraction zone 200. The extraction zone 200 can receive a prewashed hydrocarbon stream 140 from the prewash vessel 140. The extraction zone 200 can include any suitable vessels, such as an extraction vessel and an alkali regeneration zone, including an oxidation vessel and a settler. Typically, the extraction zone 200 can produce a hydrocarbon product stream and a rich alkali stream from the extraction vessel that is sent to the alkali regeneration zone to obtain a lean alkali stream provided back to the extraction vessel. An exemplary extraction zone including an extraction vessel and an alkali regeneration zone are disclosed in, e.g., U.S. Pat. No. 7,381,309.

In operation, the liquid hydrocarbon stream 50 can be combined with the solvent stream 60 to form a combined stream 80 provided to the static mixer 124 in the contacting zone 120. The contacted stream 90 can be provided to the prewash vessel 140. A hydrocarbon phase 154 can form above and have an interface 152 with an aqueous phase 156. The hydrocarbon phase 154 may rise and pass through the coalescing zone 180 resulting in the coalescing of aqueous droplets dropping back down to the bottom of the prewash vessel 140. The prewashed hydrocarbon stream 194 can be withdrawn from the prewash vessel 140 and be provided to the extraction zone 200 to obtain a hydrocarbon product stream 210.

The aqueous phase 156 can fall in the prewash vessel 140 and be withdrawn as a bottom stream 164. The bottom stream 164 can be split into a purge stream 168 and a portion 170. A control valve 160 can communicate with a level controller 158 for regulating the level of liquids in the prewash vessel 140. The portion 170 may be combined with a make-up stream 70.

The make-up stream 70 can include the solvent, which may include an alkali, an alkanolamine, and water. The alkali can include at least one potassium hydroxide, sodium hydroxide, and ammonia. The alkanolamine may include or consist of diethanolamine and/or methyl diethanolamine. A weight ratio of alkali:alkanolamine may be about 1:2-about 2:1 with the balance water. In one preferred embodiment, the make-up stream 70 can have a weight ratio of sodium hydroxide: diethanolamine of about 1:2-about 2:1 with the balance water.

The make-up stream 70 can be combined with the portion 170 to form a stream 72 to the suction of a circulating pump 174. The circulating pump 174 may provide a discharge of the solvent stream 60 combined with the liquid hydrocarbon stream 50.

Figure 2:
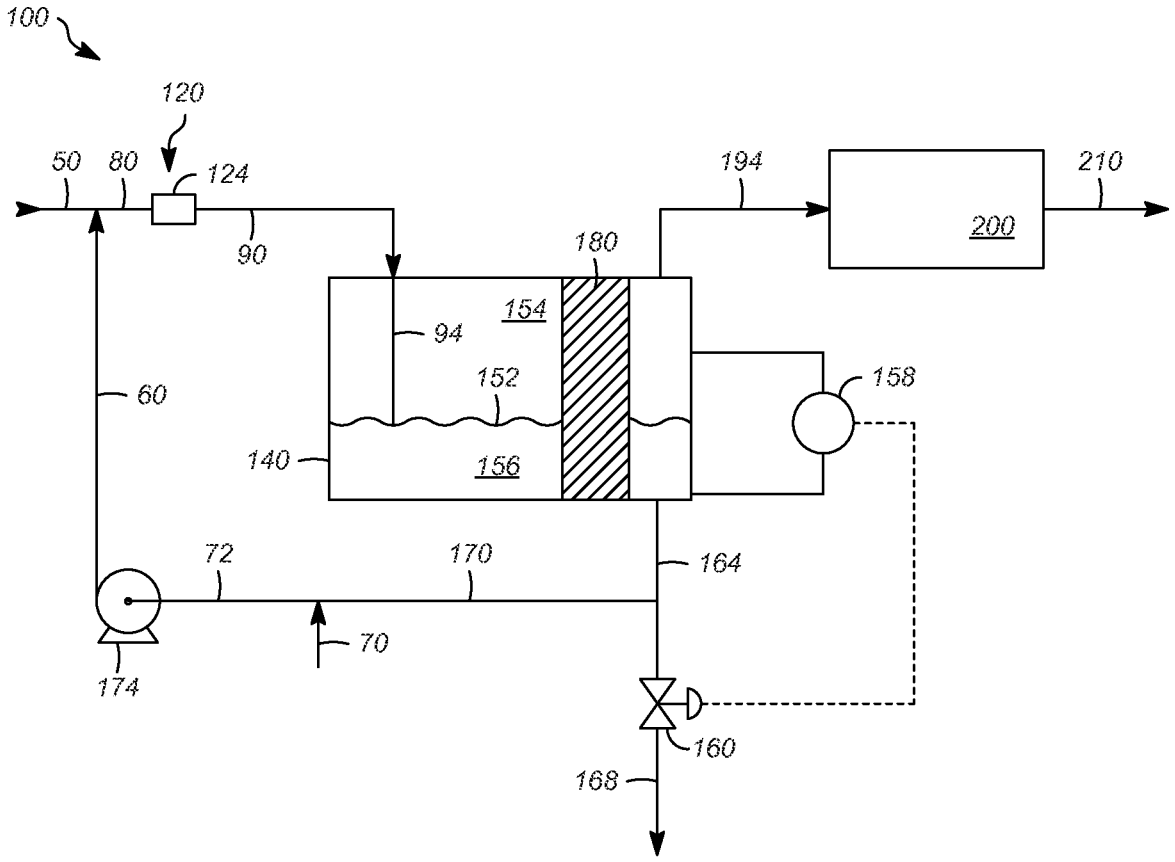
FIG. 2 is a schematic depiction of another exemplary apparatus for removing carbonyl sulfide.

Referring to FIG. 2, another version of the apparatus 100 is depicted. The primary difference in this version as compared to the version discussed above is that the vessel 140 is orientated primarily horizontal instead of vertical. So, many of the elements are the same in the two versions and may not be discussed with respect to this version. As an example, the contacting zone 120 and extraction zone 200 can be substantially identical as discussed above. Usually, the coalescing zone 180 can form a substantially vertical orientated disk dividing the prewash vessel 140 into two chambers allowing the passage of liquid there through. Also, the contacted stream 90 from the contacting zone 120 may be passed through a distributor 94 into the prewash vessel 140. The distributor 94 can be any suitable device, including a pipe with a series of holes formed about its circumference. The hydrocarbon product stream 210 can be obtained, as described above in the version depicted in FIG. 1.

In both versions, it is generally desirable to obtain the prewashed hydrocarbon stream 194 having no more than about 1 wppm of sodium, which can represent the amount of solvent carryover to downstream equipment or zones, such as the extraction zone 200. Moreover, both hydrogen sulfide and carbonyl sulfide may be removed from the hydrocarbon stream. By removing carbonyl sulfide upstream of the extraction zone 200, additional equipment can be eliminated.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing, all temperatures are set forth in degrees Celsius and, all parts and percentages are by weight, unless otherwise indicated.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for treating a liquid hydrocarbon stream, comprising:

A) combining the liquid hydrocarbon stream with a solvent comprising an alkanolamine consisting of diethanolamine, a methyl diethanolamine, or a mixture thereof, and an alkali to provide a combined stream;

B) contacting the combined stream in a contacting zone to provide a contacted stream; and C) passing the contacted stream to a vessel wherein the vessel contains a coalescing zone for removing at least one of hydrogen sulfide and carbonyl sulfide.

2. The process according to claim 1, wherein the coalescing zone comprises at least one of a mesh and one or more vanes.

3. The process according to claim 2, wherein the coalescing zone comprises the mesh wherein the mesh comprises a coating.

4. The process according to claim 3, wherein the coating comprises a hydrophilic coating.

5. The process according to claim 1, wherein the coalescing zone comprises a mesh wherein the mesh comprises one or more metal wires or fiberglass.

6. The process according to claim 1, wherein both hydrogen sulfide and carbonyl sulfide are removed.

7. The process according to claim 1, wherein the liquid hydrocarbon stream and the solvent form a combined stream passed through a contacting zone upstream of the vessel.

8. The process according to claim 1, wherein the contacting zone comprises a static mixer.

9. The process according to claim 1, wherein the solvent comprises the diethanolamine.

10. The process according to claim 1, wherein the alkali comprises at least one of an ammonia, a potassium hydroxide and a sodium hydroxide.

11. The process according to claim 10, wherein the alkali comprises the sodium hydroxide.

12. The process according to claim 1, wherein the vessel is substantially vertical orientated.

13. The process according to claim 1, wherein the vessel is substantially horizontal orientated.

14. The process according to claim 1, wherein the solvent comprises a weight ratio of alkali:alkanolamine of about 1:2-about 2:1 with a balance of the solvent being water.

15. The process according to claim 1, wherein the hydrocarbon stream comprises a liquefied petroleum gas, a naphtha, or a kerosene.

16. The process according to claim 1, further comprising sending a stream from the vessel to an extraction zone.

17. A process for treating a liquid hydrocarbon stream, comprising:

A) combining the liquid hydrocarbon with a solvent comprising a diethanolamine, an alkali, and water to provide a combined stream;

B) contacting the combined stream in a contacting zone to provide a contacted stream; and C) passing the contacted stream to a coalescing zone comprising a hydrophilic mesh for removing at least one of hydrogen sulfide and carbonyl sulfide.

18. The process according to claim 17, wherein the contacting zone comprises a static mixer and the coalescing zone is contained within a vessel.

19. A process for treating a liquid hydrocarbon stream comprising:

A) combining the liquid hydrocarbon with a solvent comprising an alkanolamine consisting of a diethanolamine, a methyl diethanolamine, or a mixture thereof, and an alkali to provide a combined stream;

B contacting the combined stream through a contacting zone to provide a contacted stream;

C) passing the contacted stream to a vessel containing a coalescing zone for removing at least one of hydrogen sulfide and carbonyl sulfide; and D) passing a stream from the vessel to an extraction zone.

20. The process according to claim 19, wherein the alkanolamine comprises the diethanolamine and the alkali comprises a sodium hydroxide and the coalescing zone comprises a coated mesh.

* * * * *